US008375676B2

(12) United States Patent
Takakura et al.

(10) Patent No.: US 8,375,676 B2
(45) Date of Patent: Feb. 19, 2013

(54) HALF PRECAST SLAB AND METHOD FOR STRUCTURING HALF PRECAST SLAB

(75) Inventors: Takeo Takakura, Tokyo (JP); Satoru Tanaka, Tokyo (JP); Yumi Tanaka, Tokyo (JP); Toshiaki Kato, Tokyo (JP); Naoyuki Kita, Tokyo (JP); Nobuyuki Kawabata, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/950,135

(22) Filed: Nov. 19, 2010

(65) Prior Publication Data

US 2011/0146190 A1 Jun. 23, 2011

(30) Foreign Application Priority Data

Dec. 22, 2009 (JP) ..... 2009-290561

(51) Int. Cl.
*E04C 2/04* (2006.01)

(52) U.S. Cl. ..... 52/742.14; 52/414; 52/602; 52/745.21

(58) Field of Classification Search ..... 52/602, 52/600, 601, 414, 372, 373, 371, 742.14, 52/745.21
See application file for complete search history.

(56) References Cited

U.S. PATENT DOCUMENTS

| | | | | | |
|---|---|---|---|---|---|
| 850,112 | A | * | 4/1907 | Hendrickson | 264/256 |
| 871,606 | A | * | 11/1907 | Moeslein | 52/414 |
| 3,049,786 | A | * | 8/1962 | Jones | 425/63 |
| 3,608,267 | A | * | 9/1971 | Curran | 52/332 |
| 3,609,935 | A | * | 10/1971 | Thomas | 52/745.11 |
| 3,935,685 | A | * | 2/1976 | Howlett | 52/223.13 |
| 3,956,864 | A | * | 5/1976 | Fung | 52/414 |
| 4,040,775 | A | * | 8/1977 | Nordbak | 425/111 |
| 4,809,474 | A | * | 3/1989 | Ekberg, Jr. | 52/223.6 |
| 4,882,889 | A | * | 11/1989 | Healy et al. | 52/336 |
| 4,942,707 | A | * | 7/1990 | Huettemann | 52/259 |

(Continued)

FOREIGN PATENT DOCUMENTS

| | | | | |
|---|---|---|---|---|
| JP | 43-4378 | Y1 | | 2/1968 |
| JP | 63-148711 | U | | 9/1988 |
| JP | 01178642 | A | * | 7/1989 |
| JP | 2729718 | B2 | | 3/1998 |
| JP | 10-110498 | A | | 4/1998 |
| JP | 11-247109 | A | | 9/1999 |
| JP | 2005-226252 | A | | 8/2005 |
| JP | 2006233592 | A | * | 9/2006 |

OTHER PUBLICATIONS

International Search Report of corresponding application No. PCT/JP2010/068632 mailed Dec. 7, 2010.

*Primary Examiner* — Robert Canfield
*Assistant Examiner* — Brent W Herring

(57) ABSTRACT

Providing a half precast slab even in a case where the thickness of the slab in the site condition is too thick to apply conventional precast construction techniques. A half precast slab including a plurality of floor concrete form members and, each floor concrete form member being provided with: a bottom slab of a long length, in response to the floor concrete form member; a pair of side walls installed upright along each longitudinal edge of the bottom slab, in response to the floor concrete form member; thereby, each floor concrete form member is arranged so as to be parallel to each other and be tightly connected to the adjacent floor concrete form member, along the direction perpendicular to the longitudinal direction of each floor concrete form member; the height of the side walls other than the side walls on the most outer edge sides of the whole floor concrete form members is set at a common height that is smaller than the height of the side walls on the most outer edge sides.

4 Claims, 6 Drawing Sheets

U.S. PATENT DOCUMENTS 5,493,836 A * 2/1996 Lopez-Munoz ..... 52/602
5,881,527 A * 3/1999 Haseotes ..... 52/705
5,910,087 A * 6/1999 Carter ..... 52/371
5,956,912 A * 9/1999 Carter et al. ..... 52/396.02
6,101,779 A * 8/2000 Davenport ..... 52/602
6,631,599 B1 * 10/2003 Takagi ..... 52/579
6,948,289 B2 * 9/2005 Bravinski ..... 52/415
7,197,854 B2 * 4/2007 Bettigole et al. ..... 52/414
2005/0102951 A1 * 5/2005 Bennett ..... 52/633
2006/0265981 A1 * 11/2006 Brackett ..... 52/223.1
2007/0028552 A1 * 2/2007 DeLoach, Sr. ..... 52/677

* cited by examiner

HALF PRECAST SLAB AND METHOD FOR STRUCTURING HALF PRECAST SLAB

RELATED APPLICATIONS

The present application is based on, and claims priority from, Japanese Application Number 2009-290561, filed Dec. 22, 2009, the disclosure of which is hereby incorporated by reference herein in its entirety.

BACKGROUND OF THE INVENTION

1. Field of the Invention

The present invention relates to a half precast slab (e.g. a half precast floor slab) and a method for structuring the half precast slab that is mainly applied to a thick slab needed for a turbine foundation in a power generation house or other structures. Further, the present invention relates to a method for structuring a slab by use of the half precast slab.

2. Background of the Invention

In a construction work applying reinforced concrete (i.e. ferroconcrete), a precast construction technique is finding increasing use instead of cast in-situ concrete approach; thereby, in the precast construction technique, a plurality of reinforced concrete members manufactured in a factory are conveyed to a construction site where each reinforced concrete member is placed at each predetermined location and each adjacent reinforced concrete members is joined to the adjacent member. Thus, the reinforced concrete structure by use of the precast construction technique is formed in site.

According to the precast construction technique, a series of construction work processes in site such as structuring concrete-forms, curing the concrete installed in the concrete-forms and removing the concrete-forms can be omitted; further, the reinforcing bar arrangements in laying the reinforcing members in an area where concrete is installed can be omitted in a case where reinforcing bars are previously embedded in the precast construction structure; hence, the construction time in relation to the whole reinforced concrete work can be cut to a large degree.

The precast construction technique is classified into two major categories: the full precast construction technique, and the half precast construction technique; in the full precast construction technique, the whole precast member is manufactured as a precast structure; in the half precast construction technique, a part of a precast member is manufactured at a factory or at the site as a precast structure, and the remaining part of the member is manufactured at site by installing concrete into the precast structure brought in the site. When there is an apprehension of the weight increase regarding the member manufactured by the full cast construction technique as well as the expenditure increase due to the weight increase, then the half precast construction technique is preferably chosen.

In general, in applying the half precast construction technique to a floor structure, the part that corresponds to the floor concrete form in a case of the cast in-situ concrete is previously manufactured as a half precast floor structure (i.e. a half precast slab) at a factory; the manufactured half precast slab is conveyed to the site and each end side of the half precast slab is placed on a beam (namely, on the predetermined position); after the arrangement of the reinforcing bars as needed is performed in the space over the half precast slab, concrete is installed into the space over the precast slab; thus, an integrated composite slab (structure) is formed.

According to the half precast construction technique as described above, the wood form needed in structuring the slab in the site can be dispensed with; the advantage inherent in the precast construction technique can be made use of; further, thanks to the weight reduction due to the choice of the half precast structure, the easiness regarding the component conveyance and installation can be achieved.

REFERENCES

Patent References

Patent Reference 1: JP1999-247109
Patent Reference 2: JP1998-110498
Patent Reference 3: JP2005-226252

SUMMARY OF THE INVENTION

In constructing a power plant, early commissioning is frequently required because of the increasing demand for power or the other circumstances of the site area; and, short construction time is a prerequisite condition as is the case in constructing general buildings such as an apartment house or an office building.

In constructing a power house of a turbine plant (e.g. a steam turbine plant), however, the floor foundation of the turbine (hereafter, abbreviated to turbine foundation) has to be a slab structure of high strength and high rigidity in order that the turbine foundation bears the weight and vibration conditions regarding the turbine, for instance, in a case where the turbine foundation is configured with reinforced concrete; incidentally, the thickness of the slab often reaches 1 m or more and the main reinforcing bar which outer diameter is as thick as 32 mm is usually used.

Thus, simply on the basis of the conventional precast construction technique that is applied to the slab which thickness is at most as thick as dozens of centimeters, it is difficult to convey the precast component to the site and install the precast component into the structure under construction, as the weight of the precast slab (component) becomes excessively heavy. As a result, in such a case (of the turbine foundation construction), the constructors are compelled to give up the adoption of precast construction technique, and make use of the cast in-site concrete approach.

In view of the background as described above, the present invention aims at providing a half precast slab and a method for structuring a slab by use of the half precast slab; thereby, the structure by the half precast slab (manufactured at a factory) can realize the structure by the cast in-suit concrete approach, even when the thickness of the slab in the site condition is too thick to apply the conventional precast construction technique.

In order to achieve the objectives, as described in claim 1, the present invention discloses a half precast slab comprising:

a plurality of floor concrete form members, each of which is provided with:

a bottom slab of a long length;

a pair of side walls installed upright along each longitudinal edge of the bottom slab;

wherein, the floor concrete form members are arranged consecutively along a direction perpendicular to a longitudinal direction of each floor concrete form member so as to be parallel to each other, and each of the floor concrete form member is connected to its adjacent floor concrete form member along the direction=perpendicular to the longitudinal direction of each floor concrete form member so that one of the side walls of the floor concrete form member is in contact with one of the side walls of the adjacent concrete form member;

further wherein, a height of the side walls other than the side walls on the most outer edge sides of the consecutively arranged floor concrete form members is set at a height that is smaller than the height of the side walls on the most outer edge sides so as to form a single reinforcing bar arrangement space due to a communication of adjacent upper spaces, each of the upper spaces being a space over the bottom slab and between the side walls of the each floor concrete form member.

Further, as described in claim 2, the present invention discloses method for structuring a slab by use of a half precast slab, the half precast slab comprising:

a plurality of floor concrete form members, each of which is provided with:

a bottom slab of a long length;

a pair of side walls installed upright along each longitudinal edge of the bottom slab;

wherein, the method comprises steps of:

arranging the floor concrete form members consecutively along a direction perpendicular to a longitudinal direction of each floor concrete form member so as to be parallel to each other;

connecting each of the floor concrete form member to its adjacent floor concrete form member along the direction perpendicular to the longitudinal direction of each floor concrete form member so that one of the side walls of the floor concrete form member is in contact with one of the side walls of the adjacent concrete form member;

arranging reinforcing bars in a single reinforcing bar arrangement space which is formed due to a communication of adjacent upper spaces, each of the upper spaces being a space over the bottom slab and between the side walls of the each floor concrete form member, wherein the steps of installing and connecting are performed at the same time or in tandem; and installing concrete into the single reinforcing bar arrangement space;

thereby structuring a composite slab comprising the concrete, the reinforcing bars, and the floor concrete form member.

Further, a preferable embodiment according to the present invention is the method for structuring a slab by use of the half precast slab; wherein, in relation to the step of connecting the floor concrete form members, the method comprises steps of:

providing prestressing steel wires to each of the floor concrete form members along the direction perpendicular to the longitudinal direction thereof;

applying tension force to each prestressing steel wire; and fixing each end of the prestressing steel wire with a fixing member;

thereby connecting the floor concrete form members to each other.

Another preferable embodiment according to the present invention is the method for structuring a slab by use of the half precast slab, wherein the prestressing wires penetrate through a cross-section of the bottom slab of each floor concrete form member.

Another preferable embodiment according to the present invention is the method for structuring a slab by use of the half precast slab, the method further comprises the steps of: removing the fixing members or removing the fixing members and the prestressing steel wires after the appearance of the strength of the installed concrete.

Another preferable embodiment according to the present invention is the method for structuring a slab by use of the half precast slab; wherein, in relation to the step of connecting the floor concrete form members, the side walls that are adjacent to and touching each other are fastened together by a plurality of bolts, thereby connecting the floor concrete form members to each other.

In general, forming a slab structure by use of the precast slab can be feasible, in a case of general buildings where the thickness of the slab is as thick as dozens of centimeters; however, when the thickness of the slab exceeds 1 m, forming the concrete structure of the slab by use of the full precast slab is not practical, as the weight of the slab becomes excessive.

On the other hand, it is considered to structure a slab by use of a plurality of beam concrete forms which is used in constructing a beam member of general buildings is applied; thereby, the beam concrete forms are connected in the direction perpendicular to the longitudinal direction of the beam concrete forms, and the beam concrete forms are tied up. In order to structure an integrated slab with the beam concrete forms, however, the connection between a beam concrete form and the adjacent beam concrete form has to be robust; additional reinforcements to ensure the robust connection become necessary. Accordingly, for instance, in forming a turbine foundation for which strength and stiffness are required to reach a threshold of a considerably high level, such integration as described is not practical from the economical point of view.

Further, according to the conventional way, in the space inside of the beam concrete form, reinforcing bars have to be arranged individually from one beam concrete form to another beam concrete form; thus, the additional reinforcements absolutely increases the consumption of the reinforcing bars, and requires considerable amounts of time as to reinforcing bar arrangement work The applicant has made the above-described invention in view of the background regarding the field of the technology; according to this invention, a suitable method for structuring a slab by use of the half precast slab can be provided; naturally, the approach according to the half precast slab can be provided, even if the thickness of the slab in the site condition is too thick to apply the conventional precast construction technique.

In other words, in the half precast slab according to the present invention, the half precast slab comprises a plurality of floor concrete form members, each floor concrete form member being provided with:

a bottom slab of a long length;

a pair of side walls installed upright along each longitudinal edge of the bottom slab;

thereby, the whole floor concrete form members are connected along the direction perpendicular to the longitudinal direction of each floor concrete form member;

the height of the side walls other than the side walls on the most outer edge sides of the whole floor concrete form members is set at a common height that is smaller than the height of the side walls on the most outer edge sides.

In this way, an upper space is formed over the bottom slab of each floor concrete form member; the upper space over each bottom slab does not exist independently of other upper spaces; the whole upper spaces form a space area. In other words, a single (simply-connected) space is formed; thereby, the side boundaries of the space are the inner surfaces of the side walls of the floor concrete form members on the most outer edge sides regarding the half precast slab; the upper boundary of the space is a level plain including a virtual line that connects the top end of the side wall on one side (e.g. right side) of the most outer edge sides to the other side (e.g. left side in response to the right side) of the most outer edge sides;

the lower boundary of the space is substantially a level plain comprising the upper surface of the bottom slabs of the floor concrete form members.

Hence, when reinforcing bars are arranged in the single (simply-connected) space area as a reinforcing bar arrangement space, a composite slab as an integrated structure can be formed with the arranged reinforcing bars and the concrete installed afterward; further, the whole amount of the reinforcing bars required for structuring the composite slab is substantially equal to the amount of the reinforcing bars required for structuring the cast in-suit concrete slab. Moreover, since the integration necessary for structuring the slab (by the half precast method) can be performed by the arrangement of reinforcing bars in the single (simply-connected) reinforcing bar arrangement space, the connected floor concrete form members may bear the load only during the process of the concrete installation.

The half precast slab and the method for structuring a slab by use of the half precast slab according to the present invention can be widely applied to thick slabs, especially, the slabs that are to be provided with high rigidity and strength; the range of applications of the present invention includes a slab for a special construction use such as a turbine foundation in a power house and a slab structure for a general construction use (e.g. for office buildings or factory buildings etc).

There are two types of floor concrete form members: the first floor concrete form member has a cross-section of a J-shape; and the second floor concrete form member has a cross-section of a U-shape; hereby, the cross-section is in a plane perpendicular to the longitudinal direction of each floor concrete form member. The J-shape is configured with the bottom slab and a set of higher side wall and the lower side wall; the U-shape is configured with the bottom slab and a pair of lower side walls; each side wall is installed upright along each longitudinal edge of the bottom slab.

In connecting the floor concrete form members in the direction perpendicular to the longitudinal direction of each floor concrete form member, the first floor concrete form members (J-shaped cross-section members) are arranged at the most outside locations, while the second floor concrete form members (U-shaped cross-section members) are arranged between the first floor concrete form members; the higher side walls of the J-shaped cross-section members are placed at the most outsides of the connected floor concrete form members.

In connecting the floor concrete form members, the number of the floor concrete form members required may be arranged in the direction perpendicular to the longitudinal direction of the floor concrete form members, so that the side wall keeps of a floor concrete form member contact with the side wall of the adjacent floor concrete form member. However, at both the most outside locations, the floor concrete form members of the J-shaped cross-section are placed so that the higher side wall faces outside; and the J-shapes are placed symmetrically, facing to each other. The minimum configuration regarding the floor concrete form members comprises one U-shaped cross-section member and two J-shaped cross-section members; and, in response to the size (the sum of the widths of the floor concrete form members) of the to-be-structured slab, the number of U-shaped cross-section members may be increased as appropriate.

In the bottom slabs of the connected floor concrete form members, prestressing steel wires with tension force are embedded along the direction perpendicular to the longitudinal direction of the floor concrete form members, so that a pre-stressed structure is formed; thus, the bending stiffness (as well as shear stiffness) of the connected floor concrete form members around an axis parallel to the longitudinal direction is preferably enhanced. Incidentally, the side walls contribute to the enhancement of the bending stiffness of the connected structure around an axis parallel to the direction perpendicular to the longitudinal direction of the floor concrete form members.

The approach by which the floor concrete form members are connected along the direction perpendicular to the longitudinal direction of the floor concrete form members is not limited to the method as described above; for instance, instead of prestressing steel wires, prestressing steel rods can be made use of as appropriate. Further, in the step of connecting the floor concrete form members, prestressing steel wires may penetrate the parts (i.e. side wall parts) of the floor concrete form members other than bottom slabs; thereby, prestressing steel wires with tension force penetrate the floor concrete form members along the direction perpendicular to the longitudinal direction of the floor concrete form members, so that the pre-stressed structure is formed; and, both the ends of the prestressing steel wire are fixed with the fixing members. In addition, when a side wall of a floor concrete form member and the side wall of the adjacent floor concrete form member keep contact with each other, both the side walls may be fastened with a plurality of bolts that penetrates the side walls. In this way, a lot of variations in which the floor concrete form members are connected can be considered.

Further, when the prestressing steel wires are arranged so that the wires penetrate the cross-section of the bottom slab regarding each floor concrete form member, then the prestressing steel wires are not exposed in the reinforcing bar arrangement space; hence, the prestressing steel wires do not hinder the arrangement of reinforcing bars. Accordingly, the interaction between the prestressing steel wires and the reinforcing bars can be evaded; the efficiency of the design work as well as the reinforcing bar arrangement work is remarkably enhanced.

Incidentally, the prestressing steel wires and the fixing thereof may be temporary work materials; namely, these materials may not be embedded in the constructed slab. In other words, these materials may be used only while the floor concrete form members are connected so that the floor concrete form members form an integrated structure and the connected structure can bear the concrete weight during the installation of concrete; and, after the strength of the installed concrete appears, the prestressing steel wires and the fixing thereof may be removed. By the way, when the prestressing steel wires and the fixing members thereof are removed, the fixing members can be prevented from being exposed out of both the side surfaces of the constructed slab (integrated slab).

BRIEF DESCRIPTION OF THE DRAWINGS

The present invention will now be described in greater detail with reference to the preferred embodiments of the invention and the accompanying drawings, wherein.

DETAILED DESCRIPTION OF THE PREFERRED EMBODIMENTS

Hereafter, a half precast slab and a method for structuring the half precast slab according to the present invention will be described in detail with reference to the embodiments shown in the figures. Incidentally, the substantially same component in the present invention as the component in the conventional technology is marked with a same numeral; the explanation regarding the same component will not be repeated.

Figure 1:
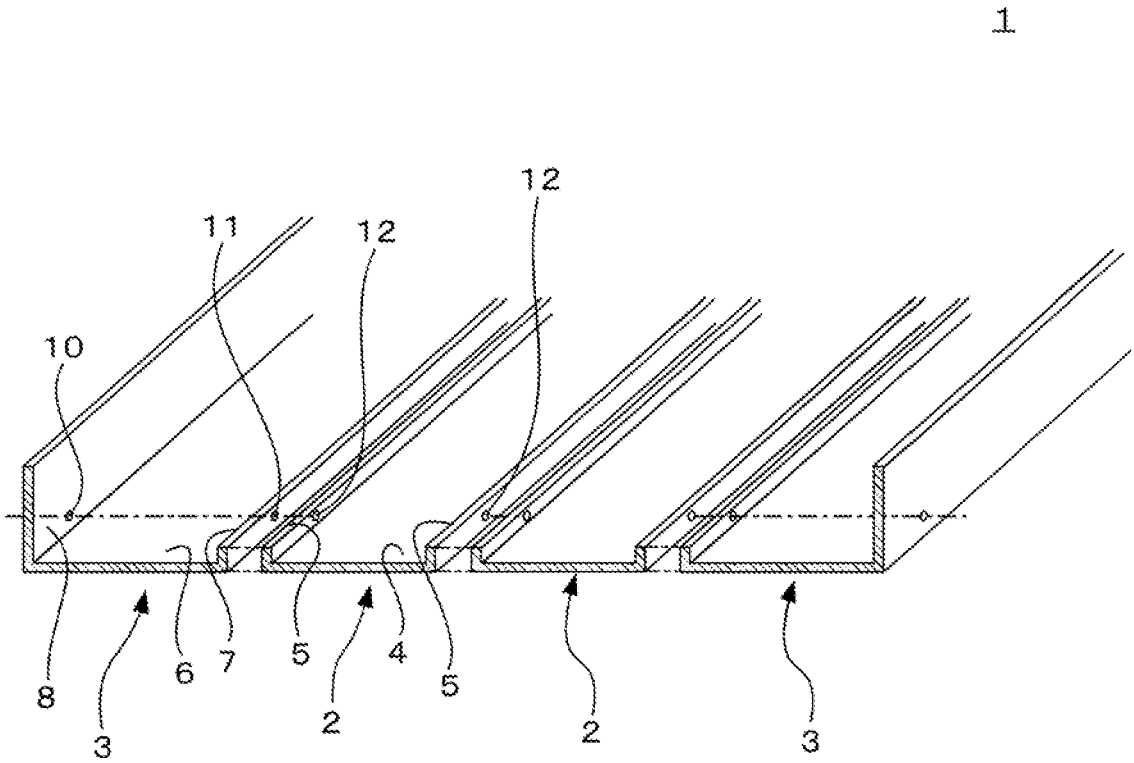
FIG. 1 shows a bird view of a half precast slab 1 according to an embodiment of the present invention.
Figure 2:
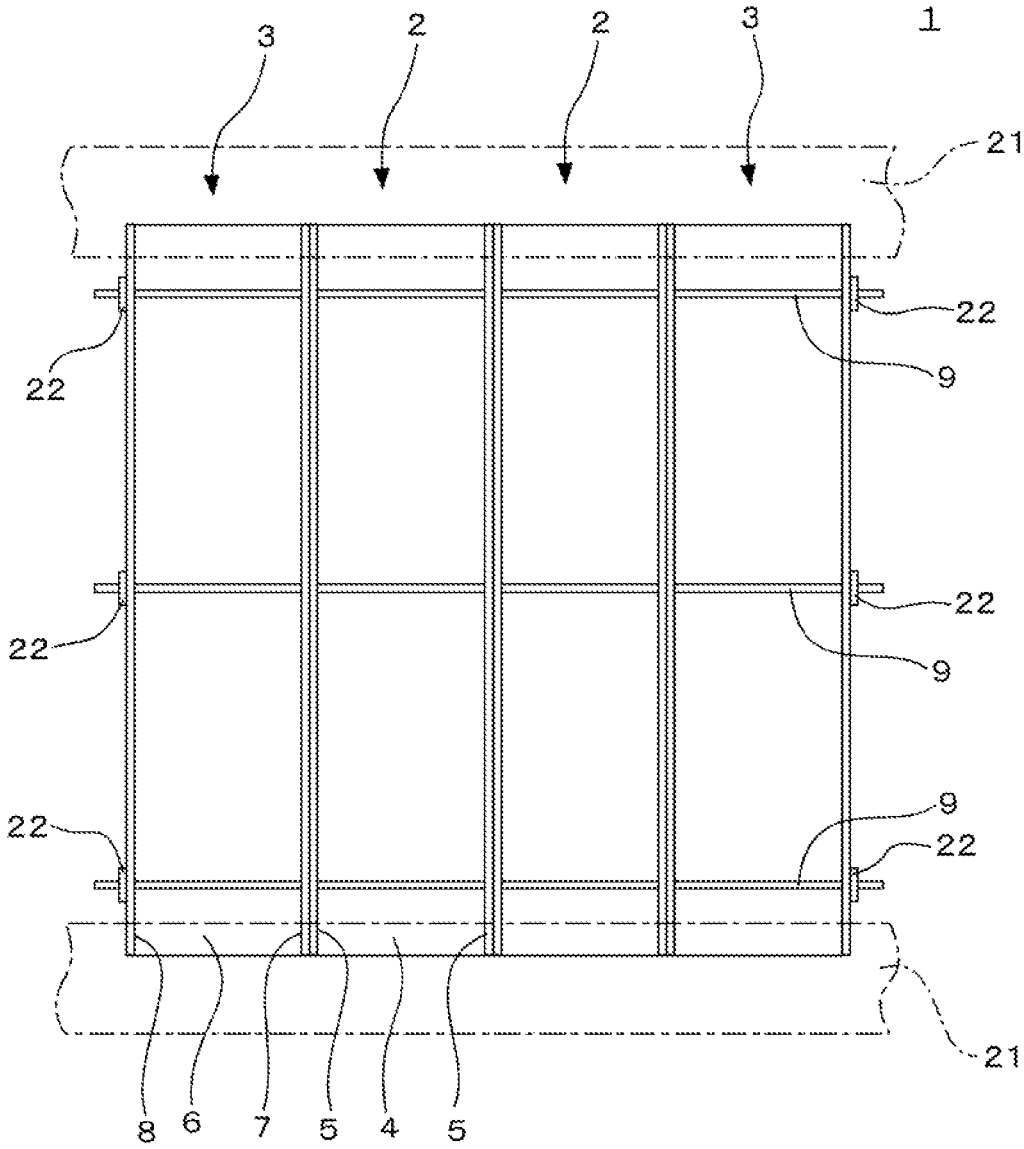
FIG. 2 shows a plan view of the half precast slab 1 according to an embodiment of the present invention.

FIG. 1 shows a bird view of a half precast slab 1 according to the embodiment of the present invention; FIG. 2 shows a plan view of the half precast slab 1 according to the embodiment of the present invention. As shown in FIGS. 1 and 2, the half precast slab 1 according to the embodiment is configured with a floor concrete form member 2 and a floor concrete form member 3; the floor concrete form member 2 is formed with a bottom slab 4 of a long length, and a pair of side walls 5 and 5 installed upright along each longitudinal edge of the bottom slab 4. Further, as is the case with the floor concrete form member 2, a floor concrete form member 3 is formed with a bottom slab 6 of a long length, and a set of side walls 7 and 8 is installed upright along each longitudinal edge of the bottom slab 6; thereby, the height of the side wall 8 is arranged so that the height is higher than those of the side walls 5 and 7; in addition, the cross-section of the whole floor concrete form members 2 forms a cross section of a U-shape, whereas the cross-section of the whole floor concrete form members 3 forms a cross section of a J-shape.

In the half precast slab 1 (in FIG. 1), two floor concrete form members 2 and 2 are connected so that the side wall 5 of one floor concrete form member 2 keeps in contact with the side wall 5 of the other floor concrete form member 2, and each floor concrete form member 2 is parallel to the other floor concrete form members 2 in the longitudinal direction regarding the side walls. Further, on the other edge side of one floor concrete form member 2 where the one floor concrete form member 2 does not keeps in contact with the other floor concrete form member 2, the side wall 5 of the one floor concrete form member 2 keeps in contact with the side wall 7 of the floor concrete form member 3 so that the floor concrete form member 2 and the floor concrete form member 3 are connected each other, and the floor concrete form member 2 is parallel to the other floor concrete form members 3 in the longitudinal direction regarding the side walls. Further, the floor concrete form members 2 and the floor concrete form members 3 are mutually connected tightly in the direction intersecting at right angles to the above-described longitudinal direction, by use of a plurality of prestressing steel wires 9.

Figure 3:
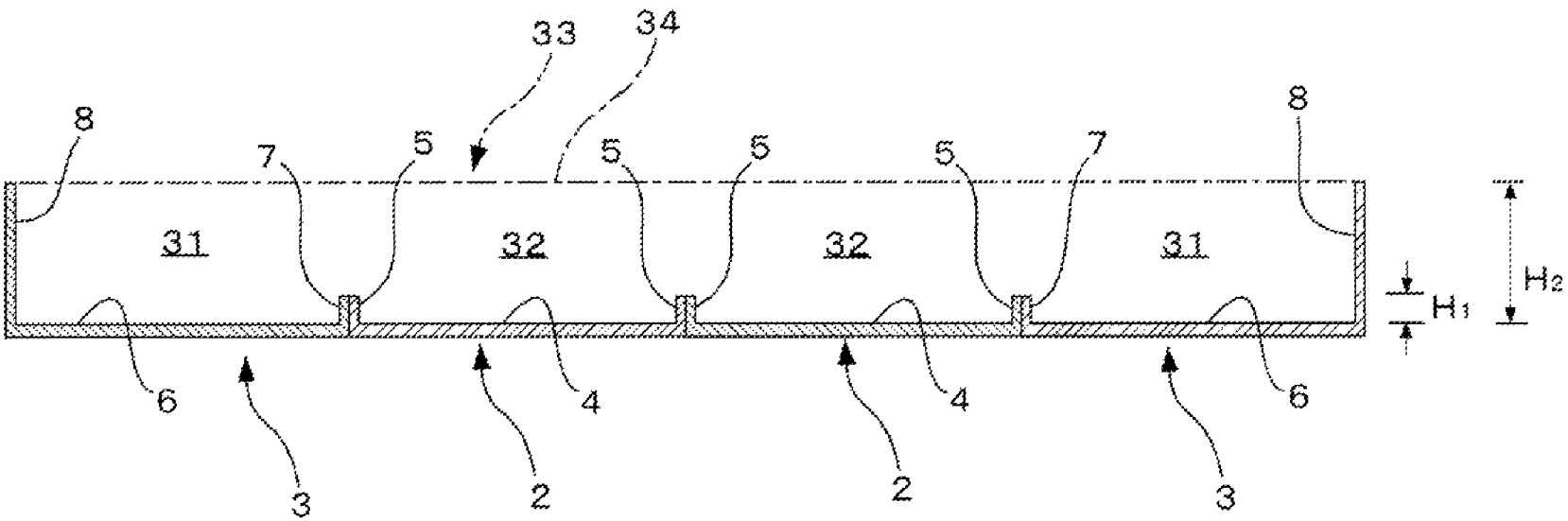
FIG. 3 is a cross-section that shows how a reinforcing bar arrangement space 33 is eventually formed when a plurality of spaces 31 and 32 communicate with each other in a horizontal direction by connecting floor concrete form members 2 and 3.

Hereby, as shown in FIG. 3, the height $H_1$ of the side walls 5 and 7 other than the side walls 8 on the most outer edge sides is arranged so that the height $H_1$ is smaller than the height $H_2$ of the side walls 8 on the most outer edge sides; further, a space 31 is formed over the bottom slab 6 (or the floor concrete form member 3) and a space 32 is formed over the bottom slab 4 (or the floor concrete form member 2); thus, because of the condition that the height $H_1$ is smaller than the height $H_2$, the upper spaces 31 and 31 (cf. FIG. 3) and the upper spaces 32 and 32 (cf. FIG. 3) are connected in a level direction so as to form a reinforcing bar arrangement space 33.

For instance, the width, the longitudinal length and the thickness (e.g. bottom slab thickness) regarding the floor concrete form members 2 and 3 are 3,500 mm, 10,000 mm, and 200 mm, respectively; and, the height $H_2$ of the side walls 8 and 8 is 1,500 mm and the height $H_1$ of the side walls 5 and 7 is 200 to 300 mm.

Incidentally, the thickness of the composite slab manufactured by use of the half precast slab 1 comprising the floor concrete form members 2 and 3 as described above becomes 1,500 mm.

In the first place, in order to form a slab structure by use of the half precast slab 1 according to the embodiment of the present invention, the two floor concrete form members 2 and 2 and the two floor concrete form members 3 and 3 are placed on the already constructed beams, columns or walls 21 and 21 so that each concrete form member 2 or 3 builds a bridge in a direction parallel to the longitudinal direction of each concrete form member 2 or 3; thus, the floor concrete form members 3, 2, 2 and 3 are arranged so as to be connected along a direction intersecting at right angles to the longitudinal direction (cf. FIG. 2).

In the next place, under the condition that the side wall 7 of the floor concrete form member 3 touches the side wall 5 of the floor concrete form member 2, as well as, the side wall 5 of the one floor concrete form member 2 touches the side wall 5 of another floor concrete form member 2, the floor concrete form members 2 and the floor concrete form members 3 are mutually bound tightly in the direction intersecting at right angles to the longitudinal direction regarding the floor concrete form members 2 and 3, by use of the prestressing steel wire 9.

As shown in FIG. 1, in the connecting process as described above, each floor concrete form member 3 is provided with a hole 10 in the side wall 8 and a hole 11 in the side wall 7, so that the prestressing steel wire 9 is inserted into the holes 10 and 11; further, each floor concrete form member 2 is provided with two holes 12 and 12 in the side walls 5 and 5, so that the prestressing steel wire 9 is inserted into the holes 12 and 12; after the prestressing steel wire 9 is inserted through the holes 10, 11, 12 and 12, the prestressing steel wire 9 is tightened with a tension force; then, at each end of the prestressing steel wire 9, a fixing member 22 is provided so that the prestressing steel wire 9 is fixed with the tension force.

Incidentally, when it is required that concrete leakage be prevented in installing concrete into the half precast slab, then a sealant is preferably arranged between the side wall 7 of the floor concrete form member 3 and the side wall 5 of the floor concrete form member 2, so that the side wall 5 keeps contact with the side wall, via the sealant.

Similarly, a sealant is preferably arranged between the side walls 5 and 5 of the floor concrete form members 2 and 2, so that the side walls 5 and 5 keep contact with each other, via the sealant.

As described above, when the floor concrete form members 2, 2, 3 and 3 are bound tightly by use of the prestressing steel wires 9, a space 31 is formed over each bottom slab 6 (or each floor concrete form member 3) and a space 32 is formed over each bottom slab 4 (or each floor concrete form member 2), as depicted in FIG. 3; further, the spaces 31 are formed over the bottom slabs 6 (or the floor concrete form members 3) and the spaces 32 are formed over the bottom slabs 4 (or the floor concrete form members 2); each space 31 or 32 does not exist independently from others spaces; namely, the upper spaces 31 and 31 (cf. FIG. 3) and the upper spaces 32 and 32 (cf. FIG. 3) are connected so as to form the reinforcing bar arrangement space 33.

In this way, the reinforcing bar arrangement space 33 is formed; thereby, the side boundaries of the space 33 are the inner surfaces of the side walls 8 of the floor concrete form members 3 on the most outer edge sides regarding the connected floor concrete form members; the upper boundary of the space 33 is a level plain including a virtual line 34 that connects the top end of the side wall 8 on one side floor concrete form member 8 to the top end of the side wall 8 on the other side floor concrete form member 8; the lower boundary of the space 33 is substantially a level plain comprising the upper surfaces of the bottom slabs 6 of the floor concrete form members 3 and the upper surfaces of the bottom slabs 4 of the floor concrete form members 2. In the reinforcing bar arrangement space 33 formed as described above, reinforcing bars are arranged.

Figure 4:
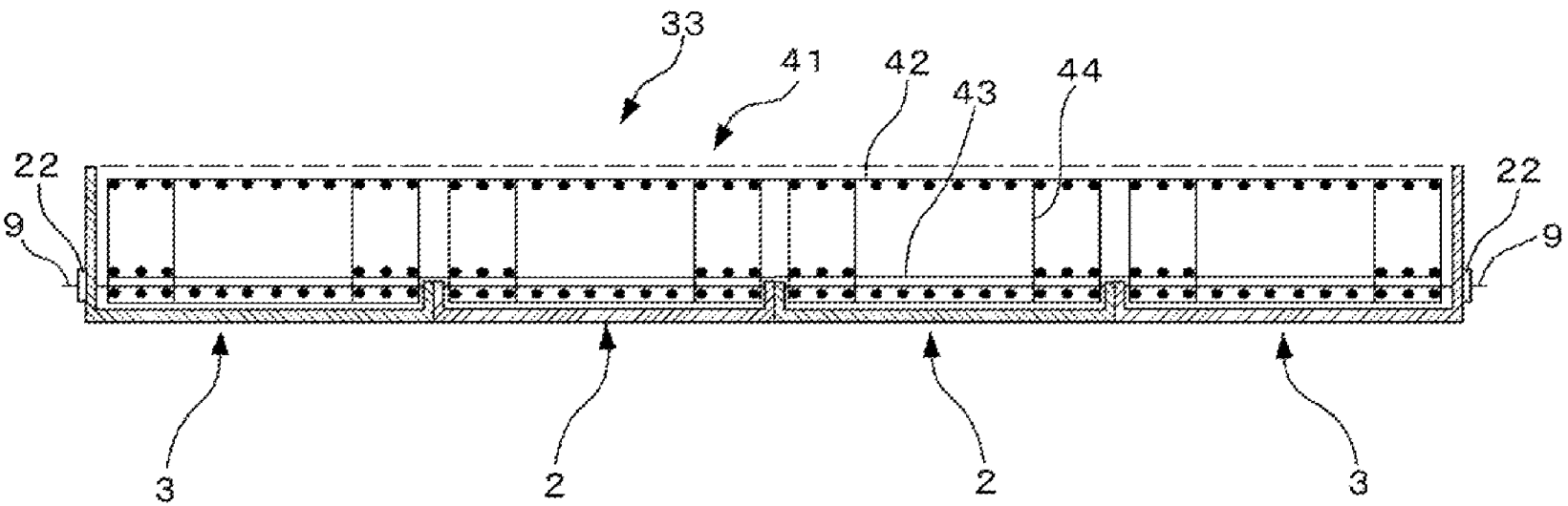
FIG. 4 shows a cross-section of the slab configured by use of the half precast slab according to an embodiment of the present invention.

FIG. 4 depicts an example that shows how a plurality of reinforcing bars 41 is arranged in the reinforcing bar arrangement space 33; as shown in FIG. 4, the reinforcing bars 41 comprise a plurality of upper end reinforcing bars 42, a plurality of lower end reinforcing bars 43 and a plurality of shear reinforcing bars 44 (that resist against the shearing stress in the concrete structure). Further, the reinforcing bar arrangement space 33 is an integrated space comprising a space over a bottom slab 31 and a space over a bottom slab 32; thus, the reinforcing bars to be arranged in the space 33 can be freely arranged without interaction from the floor concrete form members 2 and the floor concrete form members 3, in the area from the left end to the right end of the half precast slab 1 in FIG. 4.

In FIG. 4, the reinforcing bars that are placed in a horizontal direction (namely, in a direction perpendicular to the longitudinal direction regarding the floor concrete form members 2 and 3) are especially important for forming an integrated structure as a composite slab; since these reinforcing bars are arranged in the horizontal direction, it is understood that the arrangement can contribute to the structure integration for forming the composite slab.

In addition, when the height $H_1$ of the side walls 5 and 7 becomes higher, the bending stiffness of the floor concrete form members 2 and 3 is enhanced; hereby, the bending rigidity relates to the bending of the floor concrete form member as a beam along the longitudinal direction of the member; thus, the function of the side wall as a rigidity enhancing rib is intensified. On the other hand, in a case where a higher measure is adopted for the height $H_1$, the side walls are apt to hinder the reinforcing bar arrangement; hence, it becomes less easy to form an integrated structure as a composite slab.

Therefore, in determining the height $H_1$ of the side walls 5 and 7, it becomes a guide to adopt the height $H_1$ that is lower than or equal to the setting height of the bottom bar, in addition to the condition that the height $H_1$ is lower than the height $H_2$ of the side walls 8; it is hereby noted that the bottom bar is arranged in the direction perpendicular to the longitudinal direction of the floor concrete form members 2 and 3.

By use of the approach as described above, it can be surely realized to arrange the reinforcing bars that effectively contribute to the formation of the composite slab, along the direction perpendicular to the longitudinal direction of the floor concrete form members 2 and 3.

When the arrangement work as to the reinforcing bars is finished, then concrete is installed into the reinforcing bar arrangement space 33; thus, the composite slab is constructed, the composite slab comprising the installed concrete, the reinforcing bars 41 and the floor concrete form members 2 and 3.

At the tail of work, after the strength of the installed concrete becomes apparent, the fixing members 22 are removed. Further, in a case where prestressing steel wires 9 are inserted into sheath pipes (not shown) previously arranged in the floor concrete form members 2 and 3, these prestressing steel wires 9 are pulled out of the sheath pipes so as to be removed.

As described thus far, in the half precast slab 1 and a method for structuring a slab by use of the half precast slab 1 according to the present embodiment, the height $H_1$ of the side walls 5 and 7 other than the side walls 8 on the most outer edge sides is arranged so that the height $H_1$ is smaller than the height $H_2$ of the side walls 8 on the most outer edge sides; further, the spaces 31 are formed over the floor concrete form members 3, and the spaces 32 are formed over the floor concrete form members 2; each space 31 or 32 does not exist in isolation; namely, the upper spaces 31 and the upper spaces 32 are connected in a level direction so as to form the reinforcing bar arrangement space 33.

Hence, by arranging reinforcing bars in the reinforcing bar arrangement space 33 as a single (connected) space as described above, an integrated composite slab can be surely realized; thus, even in forming a slab with a great thickness, a precast construction technique can be introduced without reducing the strength and stiffness required for the to-be-formed slab.

According to the present embodiment as described above, the fixing members 22 are removed after the concrete maturation so as to prevent the members 22 from protruding from the floor concrete form members 3; in a case where there is no need to remove the fixing members 22, the members 22 may be left as they are. In addition, whether the members 22 are left or removed can be freely determined.

Figure 5:
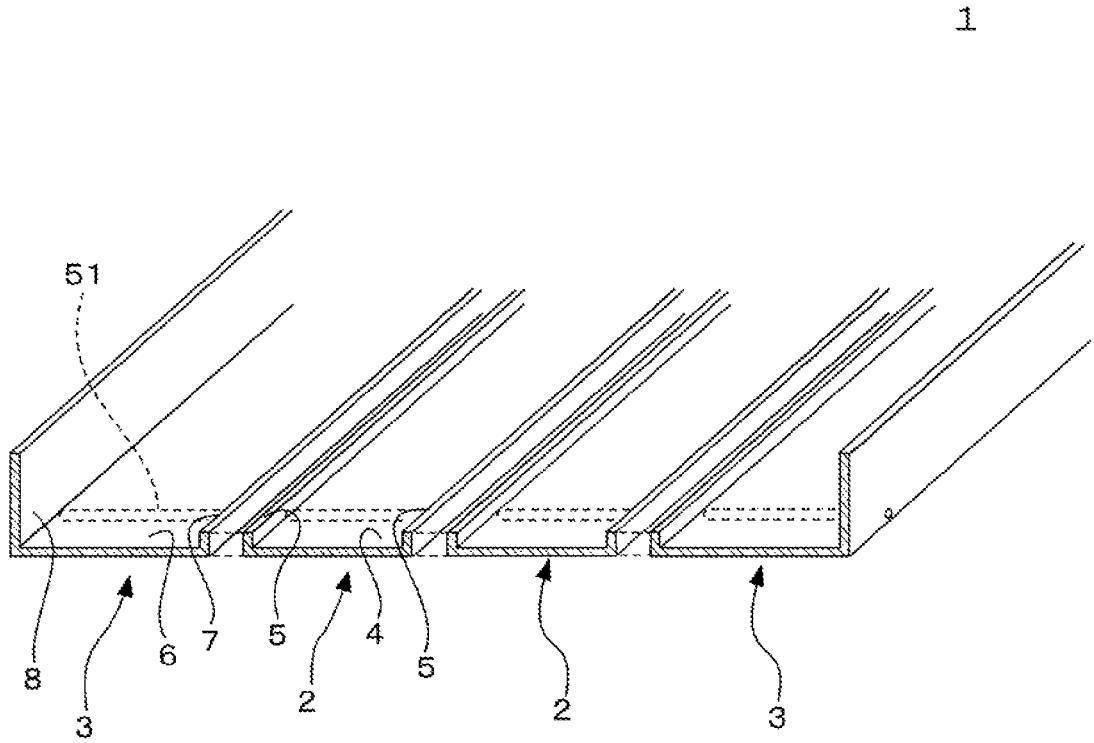
FIGS. 5(*a*) and 5(*b*) explain a method for structuring a slab, the method being a modified example according to the present invention.
Figure 5:
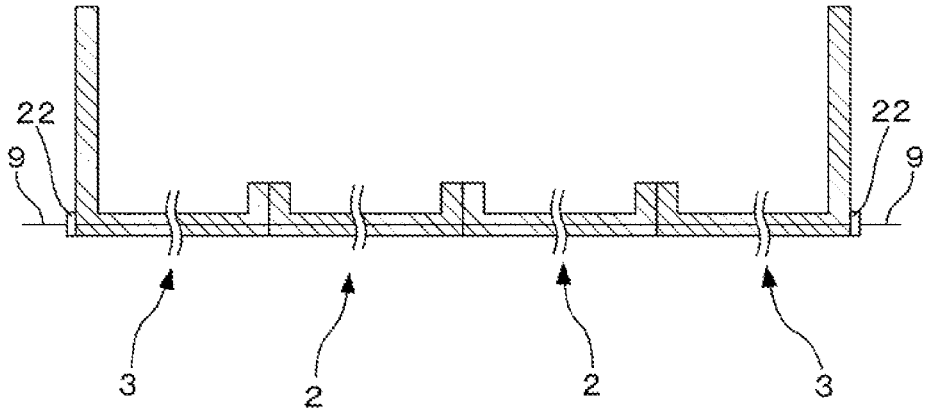

Further, in the present embodiment as described above, the prestressing steel wires 9 are arranged so as to pass through and in a level plain over the bottom slabs 4 and 6 (cf. FIGS. 1 and 5(*a*)); instead of doing so, the prestressing steel wires 9 may be arranged so as to pass through and in a level plain in the bottom slabs 4 and 6 (cf. FIG. 5(*a*)), by providing a plurality of through-holes 51 (cf. FIG. 5(*a*)) in the bottom slabs 4 and 6 in order to insert the prestressing steel wires 9 into the holes 51.

According to the variations of the present embodiment, the prestressing steel wires 9 are not exposed in the reinforcing bar arrangement space 33 so that the wires 9 do not hinder the arrangement of reinforcing bars. Accordingly, interaction between the prestressing steel wires and the reinforcing bars can be evaded; the efficiency of the design work as well as the reinforcing bar arrangement work is remarkably enhanced.

Figure 6:
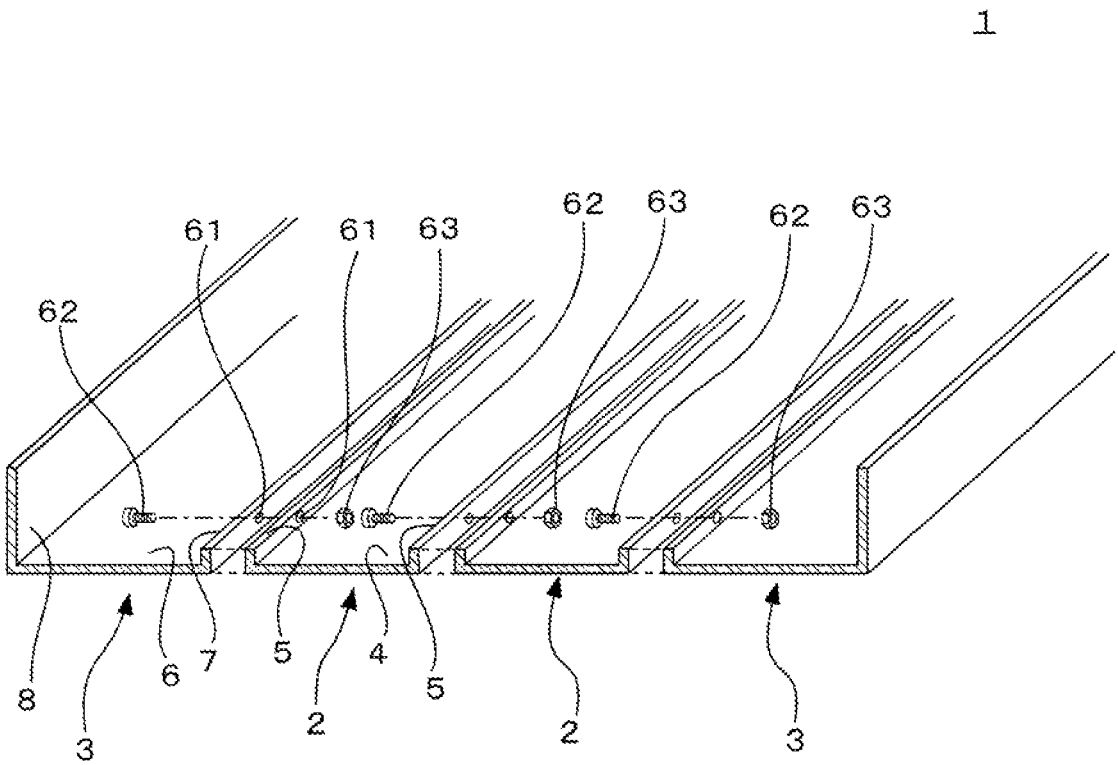
FIGS. 6(*a*) and 6(*b*) explain a method for structuring a slab, the method being another modified example according to the present invention.
Figure 6:
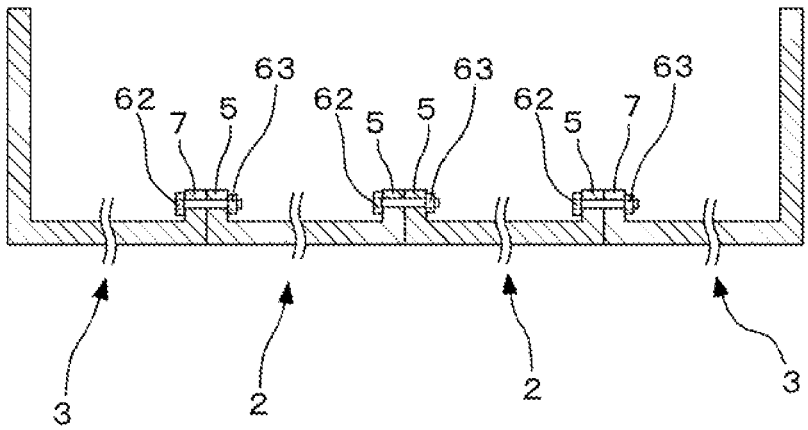

Further, according to the present embodiment, the prestressing steel wires 9 tightly bind the floor concrete form members 2 and 3; there is considerable flexibility in determining how the floor concrete form members 2 and 3 are connected in the direction perpendicular to the longitudinal direction of the floor concrete form members; as depicted in FIGS. 6(*a*) and 6(*b*), instead of the binding approach as described above, the floor concrete form members 2 and 3 may be connected among others, by use of a plurality bolts 62 and nuts 63; thereby, the bolt 62 is inserted into a pair of through-holes 61 that are provided in the side wall 7 and the side wall 5 as well as the side wall 5 and the adjacent side wall 5 so that the inserted bolt 62 is tightened by screwing the nut 63; hereby, the side wall 7 and the side wall 5 as well as the side wall 5 and the adjacent side wall 5 touch each other.

Incidentally, the numbers of the bolts and the pitch (i.e. arrangement distance) of the bolts may be determined, in view of the bolt strength to be required in installing concrete.

The invention claimed is:

1. A method for structuring a slab by use of a half precast slab, said method comprising the steps of:

arranging a plurality of precast members each of which includes a bottom part extending in a longitudinal direction, a pair of side walls provided upright on both edges of the bottom part in parallel with each other in a direction perpendicular to the longitudinal direction;

an upper space for receiving concrete surrounded by the bottom part and the pair of side walls, wherein each of the side walls, other than two outermost side walls on both edges of the arranged precast members, has a height less than the two outermost side walls so that the upper spaces of the arranged precast members are in communication with each other to form a single reinforcing bar arrangement space over the arranged precast members;

connecting the arranged precast members to each other so that the side walls of two adjacent precast members are in contact with each other;

arranging reinforcing bars in the single reinforcing bar arrangement space; and casting concrete into the single reinforcing bar arrangement space to form a composite slab comprising the concrete, the reinforcing bars, and the precast members, wherein, in the step of connecting the arranged precast members, the arranged precast members are connected to each other by:

placing prestressing steel wires along the direction perpendicular to the longitudinal direction to penetrate the arranged precast members;

applying tension force to each prestressing steel wire; and fixing each end of the prestressing steel wire with a fixing member.

2. The method according to claim 1, wherein the prestressing wires penetrate the precast members and extend inside the bottom parts.

3. The method according to claim 1, further comprising a step of removing the fixing members after the strength of the cast concrete appears.

4. The method according to claim 1, further comprising a step of removing the fixing members and the prestressing steel wires after the strength of the cast concrete appears.

* * * * *